United States Patent [19]

Hartley et al.

[11] Patent Number: 4,579,164

[45] Date of Patent: Apr. 1, 1986

[54] PROCESS FOR MAKING CAST IRON

[75] Inventors: Dean C. Hartley, Ashland, Ky.; Barry P. Schrader, Franklin, Ohio

[73] Assignee: Armco Inc., Middletown, Ohio

[21] Appl. No.: 539,689

[22] Filed: Oct. 6, 1983

[51] Int. Cl.[4] ..... B22D 27/00; C22C 33/08

[52] U.S. Cl. ..... 164/55.1; 164/57.1; 164/58.1; 75/130 B

[58] Field of Search ..... 164/473, 55.1, 57.1, 164/58.1, 59.1; 75/130 BB, 130 C, 130 B, 130 A

[56] References Cited

U.S. PATENT DOCUMENTS

| | | | |
|---|---|---|---|
| 2,870,004 | 1/1959 | Estes et al. | 75/130 BB |
| 2,995,441 | 8/1961 | Rübel | 75/130 B |
| 3,285,739 | 11/1966 | Christensen | 75/130 BB |
| 3,544,312 | 12/1970 | Turillon et al. | 75/130 B |
| 4,040,468 | 8/1977 | Nieman | 164/55.1 |
| 4,186,000 | 1/1980 | Skach, Jr. et al. | 75/130 A |
| 4,230,490 | 10/1980 | Kessl | 75/130 B |
| 4,324,587 | 4/1982 | Schüsselberger | 75/130 B |

FOREIGN PATENT DOCUMENTS

| | | | |
|---|---|---|---|
| 827556 | 5/1981 | U.S.S.R. | 75/130 C |

*Primary Examiner*—Nicholas P. Godici
*Attorney, Agent, or Firm*—Frost & Jacobs

[57] ABSTRACT

Nodular graphite type or compacted graphite type cast iron are formed by placing a low oxygen potential slag layer over a molten iron bath, adding magnesium in an amount sufficient to reduce the sulfur content in the molten iron to 0.005% maximum and to retain at least 0.01% magnesium in the molten iron. The slag layer is maintained over the molten iron bath until casting so as to prevent oxidation of the magnesium and reversion of the removed sulfur. When nodular graphite iron is being formed, the titanium concentration is maintained below 0.05%, and an inoculant is added to the molten iron bath just prior to casting. By use of a low oxygen potential slag layer to retain the removed sulfur, casting of the molten iron can be delayed for up to 10 hours after addition of magnesium to the bath.

21 Claims, No Drawings

PROCESS FOR MAKING CAST IRON

BACKGROUND OF THE INVENTION

This invention relates to cast iron, particularly of the nodular graphite iron and compacted graphite iron types. More specifically, the invention concerns a process for making cast iron of nodular graphite iron and compacted graphite iron types.

Cast iron usually contains in excess of 2.5% carbon, and upon cooling the cast iron forms either gray iron or white iron. When the cast iron is cooled rapidly so that the carbon is retained in a martensitic matrix, white iron is formed. If the cast iron is not cooled rapidly to produce white iron, then flaked graphite, compacted (vermicular) graphite, or nodular graphite is formed, depending upon the composition and physical conditions of the cast iron.

Historically, ingot molds and stools have been cast from flaked graphite iron and more recently compacted graphite iron since these forms of cast iron have good thermal conductivity and thermal shock resistance values. Unfortunately, flaked graphite and compacted graphite iron molds tend to be brittle. Consequently, ingot molds and stools cast from flaked graphite or compacted graphite iron generally fail due to cracking.

Compacted graphite iron and nodular graphite iron are produced by alloying the molten iron with magnesium and other alloying elements. The magnesium addition is usually made just prior to the pouring of the cast iron into a ladle or mold so as to avoid fade by the reaction of the magnesium with the sulfur present in the molten iron or atmospheric oxygen in contact with the molten iron bath. If the magnesium reacts with sulfur or oxygen, the concentration of magnesium present within the molten iron decreases and varies in the time interval between the magnesium addition and the eventual casting of the molten iron. When the magnesium concentration fades, the formation of a particular type of graphite is difficult to predict since typically nodular graphite iron and compacted graphite iron form within specific magnesium concentration ranges. The difficulty in predicting the particular cast iron being formed results in numerous commercial disadvantages since one must wait until the cast iron is solidified before knowing its type. If nodular iron is to be produced, a manufacturer will ordinarily overtreat with magnesium to a level where it can be predicted with confidence that nodular iron will be formed.

Conventional processes for adding magnesium as an alloy to molten iron result also in the presence of undesired amounts of silicon or nickel in the molten iron. Magnesium is often added with a buffer, such as lime or carbon, to the molten iron. An example of a process which adds magnesium to molten iron is U.S. Pat. No. 4,036,641 in the name of Edward R. Evans et al in which an alloy containing silicon, magnesium, titanium and a rare earth metal is added to the iron in a single treatment. Titanium and rare earth metal additions broaden the range for producing compacted cast iron because of the inability to control magnesium accurately.

U.S. Pat. No. 4,236,944 in the name of Melib Yaman et al discloses a cast iron especially suited for ingot molds, but fails to show a nodular graphite iron ingot mold having a microstructure of substantially nodular graphite with an alloy composition of less than 0.005% by weight sulfur, at least 0.015% by weight magnesium and a silicon to manganese ratio of less than 1.5.

U.S. Pat. No. 3,880,411 in the name of Natalya A. Voranova et al discloses an evaporation bell which allows magnesium vaporization so as to prevent plugging with a minimum gas flow. This patent does not disclose the use of a protective slag cover to absorb sulfur and to prevent magnesium from reacting with atmospheric oxygen.

In brief, prior art processes for producing cast iron have numerous deficiencies which include magnesium fading due to the reaction of the magnesium with oxygen; the need to cast the molten iron immediately after the addition of magnesium to avoid magnesium fading; unpredictability of the type of cast iron produced; the presence of contaminants within the cast iron due to the addition of magnesium alloys and buffers; and inability to combine good heat conductivity and high erosion wear resistance in cast iron molds or stools.

SUMMARY OF THE INVENTION

The process of the present invention obviates these inherent impediments in the prior art techniques by providing a process which inhibits magnesium fading and consequently allows casting of the molten iron many hours after the addition of the magnesium while still obtaining predictable results as to the type of cast iron being formed. The present process allows magnesium to be added to the molten iron bath without accompanying contaminating alloys and buffers. Finally, castings such as stools and molds formed by the present process possess both the excellent heat conductivity and high erosion wear resistance properties normally associated with these cast irons.

According to the invention there is provided a process for producing cast iron which comprises providing a molten iron charge in a transfer vessel; placing a low oxygen potential slag layer over the charge in the vessel; adding magnesium to the molten iron beneath the slag layer in an amount sufficient to reduce the sulfur content in the molten iron to about 0.005% maximum and to retain at least about 0.01% magnesium in the molten iron; maintaining the low oxygen potential slag layer over the molten iron whereby to prevent oxidation of the magnesium and reversion of the removed sulfur; and casting the molten iron.

In one embodiment of the present process, the molten pig iron normally used to produce compacted graphite or nodular graphite cast iron is desulfurized to not more than 0.005% sulfur and magnesium is retained at a level not less than about 0.01% by weight. Desulfurization may be effected by injecting pure magnesium into the molten iron using an inert carrier gas.

In another embodiment, the present invention provides a process for producing castings such as iron stools and ingot molds of the nodular graphite iron type, which comprises placing a low oxygen potential slag layer over the molten iron bath; adding sufficient magnesium to reduce the sulfur content in the molten iron to about 0.005% maximum and retain at least 0.01% magnesium. The slag layer is maintained over the molten iron bath until the molten iron is ready to be cast. The slag layer absorbs sulfur and prevents oxidation of the magnesium. An inoculant, such as foundry grade 75% FeSi, FeSi, FeMn, or high C FeMn, should be added to the molten iron to provide nucleation sites on which the graphite nodules may form. Preferably the amount of titanium in the molten iron bath is controlled to a level less than 0.05%.

The present process may thus produce a casting comprising, in weight percent, about 2.5% to about 5.0% carbon, at least 0.01% magnesium, not more than about 0.005% sulfur, less than 0.05% titanium, and the balance iron with normally occuring impurities. The microstructure of this composition comprises at least 90% by volume nodular graphite iron.

DETAILED DESCRIPTION

The process of the invention begins with the production of pig iron in a blast furnace, cupola, electric furnace, or the like. The molten iron is poured into a transfer vessel, e.g. a torpedo car. Sufficient slag from the blast furnace is retained in the transfer vessel to protect the iron from atmospheric oxygen. Where the iron is not obtained from a blast furnace, a synthetic slag with high sulfur partition ratios and low oxygen potential may be used.

The vessel containing the molten iron is transferred to a treatment station. Often, the sulfur content exceeds about 0.035% in the molten iron. The molten iron may be preliminarily desulfurized in conventional manner (e.g., with calcium carbide), before addition of magnesium. Magnesium metal, such as powdered salt coated magnesium of the type disclosed in U.S. Pat. No. 4,186,000, is added, and is preferably injected through a lance and using nitrogen gas. After a calculated amount of magnesium is added, the sulfur content is determined. The magnesium addition is then continued until sulfur is reduced to a maximum of about 0.005% and/or sufficient magnesium is present to produce the desired type of cast iron.

The practice of injecting magnesium, rather than making ladle additions, minimizes the loss of magnesium by oxidation, and hence is beneficial from the cost standpoint.

In the absence of sufficient slag, or in the absence of a non-reactive slag, oxygen from the air reacts with molten iron in the bath. The alloyed magnesium in the bath is oxidized by iron oxide. Alternatively, oxygen from the air or iron oxide in the slag may react with magnesium sulfide previously absorbed into the slag cover, causing sulfur to revert back into the molten iron. Since the molten iron may be retained for extended periods of time before being transported to a foundry for casting, sufficient deoxidized slag is needed both to retain the sulfur and to insulate the molten iron bath from air.

The process of the invention also produces cast iron of either the nodular graphite type or compacted graphite type which can be used in castings, such as stools and ingot molds. The present process controls magnesium fade and provides predictability in the cast iron by maintaining a non-reactive slag layer over the molten iron bath during processing, which prevents reversion of sulfur back into the molten metal or oxidation of magnesium by air. The molten iron can be cast many hours after the magnesium addition. Consequently, practice of the present process can provide a stool or ingot mold of substantially nodular graphite cast iron having high heat conductivity and erosion water resistance properties.

As indicated above the molten iron starting material of the process is usually pig iron. Depending upon the starting materials, the molten iron may contain a variety of impurities such as titanium, phosphorus and sulfur. Often the sulfur content of pig iron is greater than 0.035% by weight, and titanium may be present up to 0.1%.

The slag layer is preferably blast furnace slag since this is non-reactive. However, other forms of synthetic slag may also be effectively used in the process of the invention. The amount of slag necessary in the process is dependent upon the surface area of the molten iron bath and the fluidity of the slag. The slag should be well reduced and able to hold the sulfur transferred from the molten iron during the desulfurization treatment.

At least 0.01% by weight magnesium is retained in the molten iron bath having the slag cover. The magnesium preferentially reacts with the sulfur in the molten iron. Sufficient magnesium is mixed with the molten iron to reduce the sulfur content to a level not greater than 0.005% by weight. Some of the magnesium added alloys with the iron providing the 0.01% magnesium aim. Preferably magnesium is added to the molten iron by injection thereof in a fluidized state into the bath. A lance may be used to introduce the magnesium stream at an angle into the bath in order to promote stirring and avoid splashing. Relatively pure magnesium granules are preferred because they are free of other metals such as silicon, nickel and cesium, and do not contain buffers such as lime or carbon. These metals would contaminate the molten iron bath. If compacted graphite iron is desired, the magnesium concentration in the molten iron is at least about 0.01% by weight and titanium is present in amounts of at least about 0.05%. If nodular graphite type iron is to be produced, greater than 0.01% magnesium should be retained in the molten iron, except as noted hereinafter, while maintaining the titanium below 0.05%. If nodular iron is desired and the titanium content exceeds 0.05% the titanium needs to be chemically tied to nitrogen or oxidized from the bath prior to magnesium treatment.

By using a low oxygen potential slag layer over the molten iron bath, the present process permits the production of the desired type of cast iron, either compacted graphite iron or nodular graphite iron, without conjecture, since sulfur is retained within the slag layer and oxygen absorption is minimized. The magnesium remaining in solution or alloyed with the iron will not fade significantly in concentration, and accordingly the molten iron may be cast hours later with predictable and reliable results as to composition.

When the present process is used to produce nodular graphite type cast iron, it is preferred that other steps be included in order to ensure the formation of this type of iron. Titanium retards the formation of nodular graphite iron, and the titanium concentration is thus preferably controlled to a level below 0.05% by weight. Just prior to casting of the molten iron an inoculant is added to the molten iron to provide nucleation sites. When these additional steps are used in the present process, the amount of magnesium needed in the bath to assure formation of nodular graphite iron is at least 0.01% by weight.

The preferred inoculant is foundry grade 75% FeSi, but other inoculants known in the art may also be used.

Satisfactory results have been obtained when producing nodular graphite iron by adding enough inoculant to increase the silicon level in the molten bath by about 0.25%. This is believed to be significantly less than the additions disclosed in the prior art.

The concentration of various retardants, such as titanium, cesium and misch metal in the molten iron is preferably maintained below about 0.05% in order to encourage the formation of nodular graphite iron. In contrast to this, when it is desired to produce compacted graphite iron, the titanium concentration is preferably increased above 0.05% in order to inhibit the formation of nodular graphite while encouraging the production of compacted graphite. Retardants can broaden the magnesium range at which compacted graphite iron will form. In producing compacted graphite iron the retardant may be mixed into the molten iron bath shortly after the addition of magnesium if a sufficient concentration of the retardant is not already present.

When the present process is practiced so as to form nodular graphite cast iron, the liquid iron may be cast, e.g. into ingot molds or stools, many hours after the magnesium treatment of the molten iron since the maintenance of a non-reactive slag layer over the iron bath prevents the reaction of magnesium with oxygen. As previously mentioned, an inoculant is added to the iron bath just prior to pouring. The resulting castings exhibit high erosion wear resistance properties. It is believed that a silicon to manganese weight ratio of less than 1.5, which can be produced by the present process, causes a pearlitic matrix to form. The pearlitic structure produced by the low silicon to manganese ratio gives heat conductivity values very similar to those of flaked graphite while also providing high wear erosion resistance. Prior art processes which produce castings through FeSi alloys containing magnesium have difficulties in producing this type of composition.

As indicated above, inoculants should be added to the molten iron in order to form nodular graphite iron. When titanium is controlled below 0.05%, nodular graphite iron is formed by the present process when the magnesium concentration is about 0.01%.

When the present process is conducted in such manner as to form nodular graphite cast iron, the resulting composition preferably has a magnesium concentration greater than about 0.01%, a sulfur concentration of less than 0.005%, a titanium concentration of less than 0.05%, with the balance iron and normally occurring impurities. A casting formed from this composition has a microstructure containing at least 90% by volume nodular graphite iron.

The following specific examples illustrate the practice of the present invention:

EXAMPLE 1

A molten iron bath was collected in a transfer vessel from a blast furnace having a temperature of about 2600° F. A low oxygen potential layer of blast furnace slag was placed over the bath. Sufficient magnesium was then added in fluidized form through a lance inserted at an angle below the bath surface to reduce the sulfur content to 0.003%. The titanium concentration was determined to be below 0.05%. Prior to casting the molten iron into stools, by which time the bath had cooled to below 2400° F., an inoculant of 75% FeSi was added to provide nucleation sites. The results are reported in Table 1.

These results indicate the importance of maintaining the titanium, sulfur and magnesium levels within the desired parameters.

EXAMPLE 2

The process of Example 1 was followed, except that the titanium concentration was above 0.05% by weight, and no inoculant was added to the bath. The results are shown in Table 2.

The results indicate the effect of the titanium level above 0.05%. The stools formed by casting had a compacted graphite iron microstructure.

EXAMPLE 3

Molten iron having a composition substantially the same as that of Example 1 was collected in a transfer vessel, and a slag layer was placed and maintained over the molten iron bath. Magnesium was injected into the bath, and after addition of FeSi as an inoculant, the molten iron (Ladle 1) was poured into ten stools. Thereafter, a second ladle (Ladle No. 2) of desulfurized iron was used to pour some ingot molds. The results are summarized in Table 3. A sulfur reversion occurred in Ladle 2 which caused the metallurgical structure to vary from the first casting to the next. It is evident that the low magnesium (0.003%) reported in the second column resulted in a flake graphite structure. The reason for the sulfur reversion in this trial could not be ascertained.

The results show that the maintenance of the sulfur, titanium and magnesium concentrations within the specified parameters produces stools having a nodular graphite iron structure. These results also indicate that the sulfur level must be maintained at a maximum of 0.005% in order to prevent formation of flake graphite cast iron.

EXAMPLE 4

A molten iron bath was provided, and a slag layer was placed and maintained thereon. Magnesium was added in an amount such that less than 0.01% was retained in the molten iron bath and the sulfur content was greater than 0.005%. No inoculant was added prior to casting the molten iron into molds. The results are reported in Table 4.

These results indicate the importance of decreasing the sulfur content to a level below 0.005% in order to have sufficient magnesium present in the iron bath to result in formation of nodular graphite iron.

EXAMPLE 5

A molten iron bath was provided, and a slag layer was placed thereover. The bath was desulfurized, but less than 0.01% magnesium was retained after desulfurization. An inoculant of FeSi was added to the molten iron, followed by casting into ten stools. The results are given in Table 5.

This table shows that a low sulfur concentration (0.002% by weight) at the time of casting is not sufficient to form nodular graphite iron even with the addition of an inoculant, if sufficient magnesium is not retained in the iron bath. The criticality of a magnesium content of at least about 0.01% after magnesium treatment in forming nodular graphite iron is thus demonstrated.

The data of Examples 1 through 5 are summarized in Table 6 in order to show the effects of the sulfur, titanium and magnesium concentrations and the presence of an inoculant upon the matrix structure of the cast iron produced by the present process. It is evident that nodular graphite iron microstructure is produced when sulfur is below 0.005%, titanium is below 0.05%, magnesium is present in an amount of at least 0.01%, and an inoculant is added to the molten iron bath just prior to casting. If one or more of these parameters is altered or absent the present process may not form nodular graphite cast iron.

The cast stools produced in Examples 1 through 5 were tested for tensile strength and Brinell hardness, and these properties are reported in Table 7. The results demonstrate that nodular graphite cast iron has higher tensile and hardness values than compact graphite iron or gray iron compositions.

In the above examples the castings were poured as soon as 7 hours after desulfurization. However other castings were poured as long as 10 hours after desulfurization in the practice of the present process, and magnesium fade was noted to be minimal through control of sulfur reversion and air oxidation during delays of this magnitude.

The analyses reported in Tables 1-5, except for percent sulfur at Desulfurizer and percent sulfur at Foundry, are of the castings and not of the molten metal.

TABLE NO. 1

| | |
|---|---|
| Bottle Temperature (at foundry) | 2400° F. |
| Ladle Temperature | 2380° F. |
| Ladle additions | 75% FeSi |
| Ladle Skull | Heavy |
| Castings Produced | 8 Stools |
| Time-desulfurizing to filling ladle | 10 1/6 hrs |
| % S at Desulfurizer | .003% |
| % S at Foundry | .003% |
| Analysis of Casting | |
| % C | 3.82 |
| Mn | .85 |
| P | .077 |
| S | .003 |
| Si | 1.11 |
| Cu | .004 |
| Carbon Equivalent | 4.22 |
| Mg | .017 |
| Ti | .039 |
| Si/Mn | 1.31 |
| Micro Structure | |
| Graphite | 90% Nodular |
| Matrix | Ferrite around the nodules; 70% pearlite massive carbides |

TABLE NO. 2

| | |
|---|---|
| Bottle Temperature (at foundry) | 2460° F. |
| Ladle Temperature | 2422° F. |
| Ladle Additions | None |
| Ladle Skull | Heavy |
| Castings Produced | 7 Stools |
| Time-desulfurizing to filling ladle | 8 hours |
| % S at Desulfurizer | .004% |
| % S at Foundry | .003% |
| Analysis of Casting | |
| % C | 3.85 |
| Mn | .82 |
| P | .099 |
| S | .002 |
| Si | 1.48 |
| Cu | .005 |
| Carbon Equivalent | 4.38 |
| Mg | .016 |
| Ti | .072 |
| Si/Mn | 1.80 |
| Micro Structure | |
| Graphite | Compacted |
| Matrix | 80% Ferrite |

TABLE NO. 3

| | Ladle 1 | Ladle 2 | |
|---|---|---|---|
| Bottle Temperature | 2230° F. | 2230° F. | |
| Ladle Temperature | 2210° F. | Not Recorded | |
| Ladle Additions | 75% FeSi | None | |
| Ladle Skull | Heavy | Heavy | |
| Castings Produced | 10 - 80" stools | 2 - 28 × 64" Molds | |
| Time-desulfurizing to filling ladle | 7 hours | 1 - 27 × 44" mold 8 1/6 hours | |
| % S at Desulfurizer | .002 | .002 | .002 |
| % S at Foundry | .001 | .001 | .001 |
| Analyses of Casings | | | |
| % C | 3.92 | 3.79 | 3.74 |
| % Mn | .69 | .70 | .69 |
| % P | .10 | .10 | .10 |
| % S | .001 | .001 | .008 |
| % Si | 1.14 | 1.01 | .95 |
| % Cu | .014 | .013 | .015 |
| % Carbon Equivalent | 4.3 | 4.16 | 4.09 |
| % Mg | .018 | .014 | .003 |
| % Ti | .035 | .032 | .019 |
| Micro Structure | 100% Nodular | Compacted | Flake |
| Matrix | Pearlitic <Ferrite | <10% Nodular 50% Ferrite | 20% Ferrite |

TABLE NO. 4

| | |
|---|---|
| Bottle Temperature (at foundry) | 2350° F. |
| Ladle Temperature | 2245° F. |
| Ladle Additions | None |
| Ladle Skull | Heavy |
| Castings Produced | 2 - 28 × 64" molds |
| Time-desulfurizing to filling ladle | 10⅓ hours |
| % S at Desulfurizer | .010 |
| % S at Foundry | — |
| Analysis of Casting | |
| % C | 4.30 |
| % Mn | .42 |
| % P | .090 |
| % S | .009 |
| % Si | .91 |
| % Cu | .008 |
| % Carbon Equivalent | 4.63 |
| % Mg | <.001 |
| % Ti | .034 |
| Micro Structure | |
| Graphite | 2 Flake |
| Matrix | 10% Ferrite |

TABLE NO. 5

| | |
|---|---|
| Bottle Temperature (at foundry) | 2350° F. |
| Ladle Temperature | 2280° F. |
| Ladle Additions | 75% FeSi |
| Ladle Skull | Heavy |
| Castings Produced | 1 - −110" stools |
| Time-desulfurizing to filling ladle | 6 5/6 hours |
| % S at Desulfurizer | .008 |
| % S at Foundry | .005 |
| Analysis of Casting | |
| % C | 3.96 |
| % Mn | .64 |
| % P | .096 |
| % S | .002 |
| % Si | 1.18 |
| % Cu | .008 |
| % Carbon Equivalent | 4.38 |
| % Mg | .003 |
| % Ti | .034 |
| Micro Structure | |
| Graphite | Flake |
| Matrix | 70% Ferrite |

TABLE NO. 6

| Trial | % S | | | Casting | | FeSi | |
|---|---|---|---|---|---|---|---|
| No. | At Desulf. | At. Fdry. | Casting | % Mg | % Ti | Inoc. | Structure |
| 1 | .003 | .003 | .003 | .017 | .039 | Yes | Nod. G - Pearlite |
| 2 | .004 | .004 | .002 | .016 | .072 | No | Comp G. - 80% Ferrite |
| 3 | .002 | .001 | .001 | .018 | .035 | Yes | Nod G - Pearlite |
| 3 | .002 | .001 | .008 | .003 | .019 | No | Flake Graphite |
| 3 | .002 | .001 | .001 | .014 | .032 | No | Comp G & Some Nod. G. |
| 3 | .002 | .001 | .001 | .012 | .029 | No | Comp G & Some Nod. G. |
| 4 | .010 | — | .009 | <.001 | .034 | No | Flake Graphite |
| 4 | .010 | — | .008 | <.001 | .032 | No | Flake Graphite |
| 5 | .080 | .005 | .002 | .003 | .034 | Yes | Flake Graphite |
| 5 | .008 | .005 | .002 | .004 | .041 | Yes | Flake Graphite |

TABLE NO. 7

| Tensile (psi) | % Elongation in 2" | Brinell Hardness |
|---|---|---|
| | I Nodular Samples | |
| 46,000 | (1) | 210 |
| 46,350 | 2.0 | 218 |
| 45,600 | 2.8 | 217 |
| 71,200 | (1) | 209 |
| 70,700 | (1) | 216 |
| | II Compacted Graphite | |
| 46,900 | 1.75 | 167 |
| 43,150 | 2.0 | 184 |
| | III Grey Iron | |
| 16,250 | 2.25 | 115 |
| 9,910(2) | — | 70 |
| 9,200(2) | — | 77 |

(1) These tensiles broke outside the gauge marks and elongations could not be measured (2) These samples are from 28 × 64" ingot molds and were run as part of a separate study. Elongations were not measured.

What is claimed is:

1. A process for producing cast iron having high heat conductivity and high erosion wear resistance which comprises:
   (a) providing a molten iron charge in a transfer vessel;
   (b) placing a non-reactive slag layer having a high sulfur partition ratio and low oxygen potential over the charge in the vessel;
   (c) adding magnesium beneath the surface of said molten iron and beneath said slag layer in an amount sufficient to reduce the sulfur content in the molten iron to about 0.005% maximum and to retain at least about 0.01% magnesium in said molten iron;
   (d) maintaining said slag layer over said molten iron whereby to prevent oxidation of the magnesium and reversion of the removed sulfur; and
   (e) casting the molten iron.

2. The process claimed in claim 1, wherein the concentration of titanium is at least 0.05% whereby to produce compacted graphite cast iron.

3. The process claimed in claim 1, wherein the concentration of titanium is less than 0.05%, whereby to produce nodular graphite type cast iron.

4. The process claimed in claim 1, wherein the magnesium addition of step (c) is performed by adding said magnesium in a fluidized state into the molten iron charge.

5. A process for producing cast iron of a nodular graphite type having high heat conductivity and high erosion wear resistance comprising:
   (a) providing a molten iron charge in a transfer vessel;
   (b) placing a non-reactive slag layer having a high sulfur partition ratio and low oxygen potential over the charge in said vessel;
   (c) adding magnesium beneath the surface of the molten iron and beneath said slag layer in an amount sufficient to reduce the sulfur content in the molten iron to less than 0.005% and to retain at least 0.01% magnesium in the molten iron;
   (d) maintaining said slag layer over said molten iron whereby to prevent oxidation of the magnesium and reversion of the removed sulfur;
   (e) adding an inoculant to said molten iron charge just prior to casting to provide nucleation sites; and
   (f) casting said molten iron.

6. The process claimed in claim 5, wherein the inoculant in step (e) is foundry grade 75% FeSi.

7. The process claimed in claim 5, wherein the inoculant in step (e) is added in an amount sufficient to maintain the silicon concentration in said molten iron within the range of about 0.25% to 2.0% by weight.

8. The process claimed in claim 5, wherein the inoculant in step (e) is added in an amount sufficient to maintain the silicon to manganese ratio below 1.5.

9. The process claimed in claim 5, wherein said inoculant is added as said molten iron is being poured into castings.

10. The process claimed in claim 5, wherein said inoculant is added to said vessel just prior to pouring said molten iron into castings.

11. The process claimed in claim 5, including the further step of maintaining the concentration of titanium in said molten iron below 0.05% by weight.

12. The process claimed in claim 5, wherein the casting of step (f) is performed about 2 to 10 hours after the addition of said magnesium to said molten iron in step (c).

13. The process claimed in claim 5, wherein the amount of slag layer is proportional to the surface area of said molten iron in said transfer vessel and the fluidity of the slag layer.

14. The process claimed in claim 5, wherein said magnesium is salt coated magnesium granules, and said magnesium is added to the molten iron with a non-oxidizing carrier gas by injecting said magnesium at an angle into the bath to avoid splashing and promote stirring.

15. The process claimed in claim 5, wherein the magnesium addition of step (c) is performed by adding said magnesium in a fluidized state into said molten iron.

16. The process claimed in claim 5, wherein said molten iron in step (f) is cast to produce ingot stools.

17. The process claimed in claim 5, wherein the molten iron in step (f) is cast to produce ingot molds.

18. A process for producing cast iron having high heat conductivity and high erosion wear resistance which comprises:
   (a) placing a nonreactive slag layer having a high sulfur partition ratio and a low oxygen potential over a molten iron bath;

(b) injecting magnesium granules by means of a non-oxidizing carrier gas into said molten iron until the sulfur is reduced to about 0.005% maximum and at least about 0.01% magnesium is retained in said molten iron;

(c) maintaining said slag layer to prevent oxidation of the magnesium and reversion of the removed sulfur; and (d) casting the molten iron.

19. The process claimed in claim 18, wherein said magnesium is injected at an angle into the bath to avoid splashing and promote stirring.

20. The process claimed in claim 18, wherein said non-oxidizing carrier gas is nitrogen.

21. The process claimed in claim 18, wherein said magnesium granules are salt coated.

* * * * *